US006899631B1

(12) United States Patent
Zuber

(10) Patent No.: US 6,899,631 B1
(45) Date of Patent: May 31, 2005

(54) SEESAW WITH ADDITIONAL MODES OF MOTION

(75) Inventor: Kevin Zuber, West Liberty, IL (US)

(73) Assignee: Kevin Robert Zuber, West Liberty, IL (US)

( * ) Notice: Subject to any disclaimer, the term of this patent is extended or adjusted under 35 U.S.C. 154(b) by 0 days.

(21) Appl. No.: 10/662,274

(22) Filed: Sep. 15, 2003

(51) Int. Cl.[7] ..... A63G 11/00
(52) U.S. Cl. ..... 472/108; 472/109
(58) Field of Search ..... 472/106, 108, 472/109, 111, 112; 280/220, 222

(56) References Cited

U.S. PATENT DOCUMENTS

| | | | | | |
|---|---|---|---|---|---|
| 525,107 | A | * | 8/1894 | Mayer | 472/108 |
| 907,562 | A | * | 12/1908 | Boettcher | 280/222 |
| 1,020,895 | A | * | 3/1912 | Fields | 280/222 |
| 1,380,893 | A | * | 6/1921 | Gebert | 280/222 |
| 1,929,081 | A | * | 10/1933 | Serpico | 280/222 |
| 2,184,097 | A | * | 12/1939 | Grampp | 280/222 |
| 2,784,968 | A | * | 3/1957 | Bakula | 472/109 |
| 3,046,011 | A | * | 7/1962 | Songer | 472/113 |
| 3,190,647 | A | * | 6/1965 | Songer | 472/113 |
| 4,186,934 | A | | 2/1980 | Collings | |
| 5,512,018 | A | * | 4/1996 | Zimmers | 472/106 |
| 5,839,737 | A | | 11/1998 | Kruczek | |
| 6,383,083 | B1 | * | 5/2002 | Johnston | 472/106 |

* cited by examiner

*Primary Examiner*—Kien Nguyen

(57) ABSTRACT

A seesaw having an elongated planar member assembly, an axle assembly, and a ratchet-and-pawl assembly. The planar member assembly includes an elongated planar member. The axle assembly includes an axle member, an elongated radial extension, and a pair of wheels. The extension member extends radially between, and is coupled to, the axle member and the planar member. The pair of wheels is coupled to the axle member with one wheel disposed on each side of the planar member. The ratchet-and-pawl assembly includes a toothed gear, which is coupled to the axle member, and a pair of pawl assemblies. Each pawl assembly has a pawl member coupled to the planar member and structured to engage the toothed gear.

12 Claims, 3 Drawing Sheets

SEESAW WITH ADDITIONAL MODES OF MOTION

BACKGROUND OF THE INVENTION

1. Field of the Invention

This invention relates to a seesaw and, more specifically to a seesaw that includes additional structures that provide modes of motion beyond the traditional pivoting up-and-down motion.

2. Background Information

Seesaws, or teeter-todders, have been used by children, and sometimes by adults, for years. In the simplest form, the seesaw is an elongated planar member, such as a flat board, having generally equal portions extending on either side of a fulcrum. Thus, the opposite ends of the planar member may move between a lower position and an upper position. Children sit on either end of the planar member thereby placing approximately equal loads on either side of the fulcrum. When one child pushes his or her side of the planar member upward by extending their legs, that side of the board is lifted into the upper position while the other end of the planar member is moved into the lower position. Then, the child in the lower position may extend his or her legs thereby reversing the motion and moving his or her end into the upper position and moving the opposite end into the lower position. This simple rocking motion is pleasant to children. Additionally, for a small child on a large seesaw, the motion may lift him or her to a height well above their standing height which also provides a thrill. While this simple rocking motion is pleasant, children may tire of the repetitive motion in time.

As such, there is a need for a seesaw that provides additional modes of motion or which enhances the simple rocking motion.

SUMMARY OF THE INVENTION

The present invention provides a seesaw having more than one mode of motion and which enhances the traditional rocking motion. The present invention provides an elongated planar member assembly coupled to a fulcrum which is an axle. The axle is coupled to a pair of wheels. A ratchet and pawl assembly disposed on the axle and planar member assembly translates the rocking motion provided by the users into a rotation of the wheels thereby causing the seesaw to travel. Additionally, a pair of radial extensions provide a space between the plane of the planar member and the pivot point of the fulcrum. This spacing enhances the rocking motion experienced by the children using the seesaw. That is, the radial extensions allow the planar member to rotate back and forth about the axle pivot point in addition to rocking back and forth on the pivot point. Thus, the motion experienced by a child using the seesaw is not a simple rocking motion. The children using the present invention experience several modes of motion including rocking, rotation and traveling. Additionally, children may use the present invention for additional games, such as racing two enhanced seesaws.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
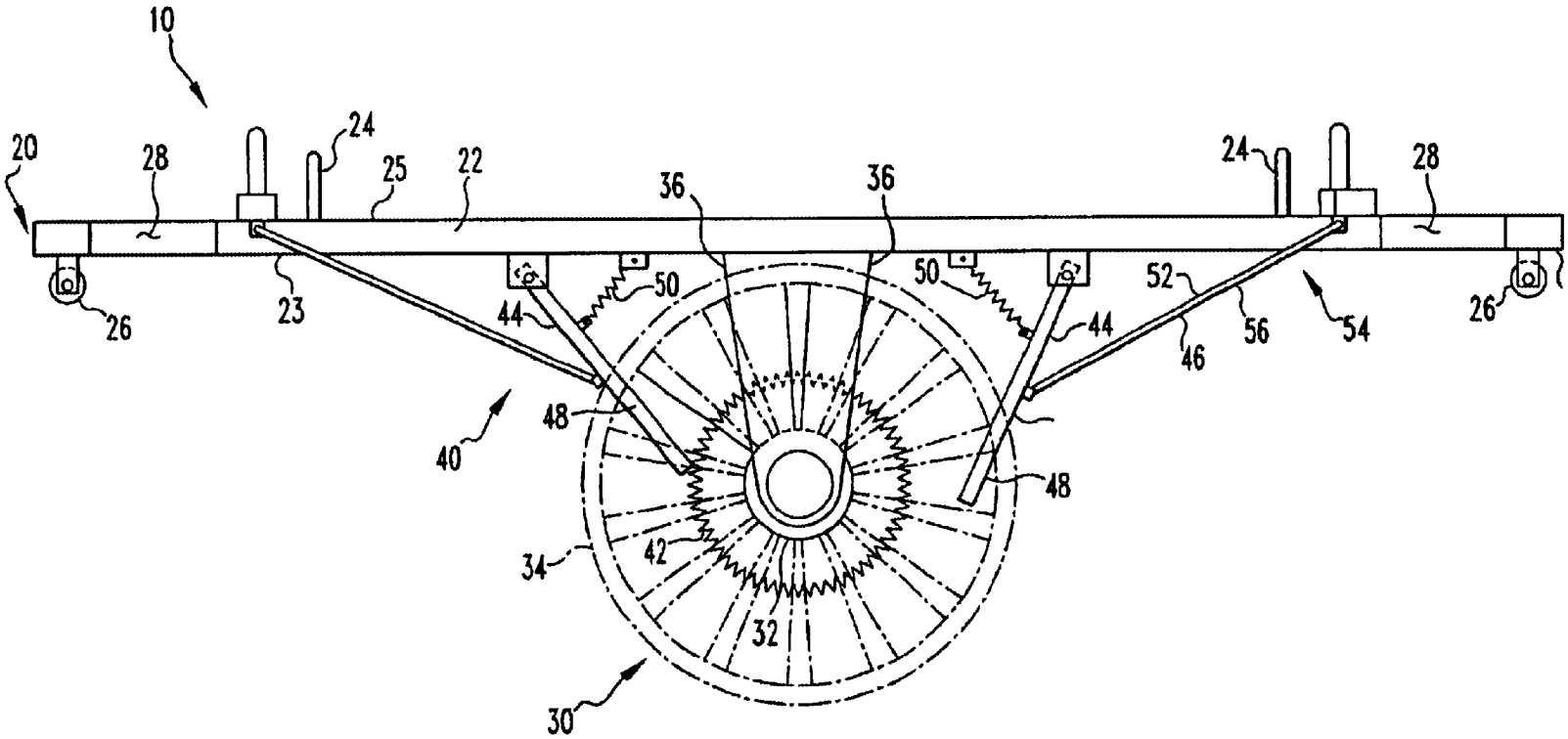
FIG. 1 is a side view of the present invention.
Figure 2:
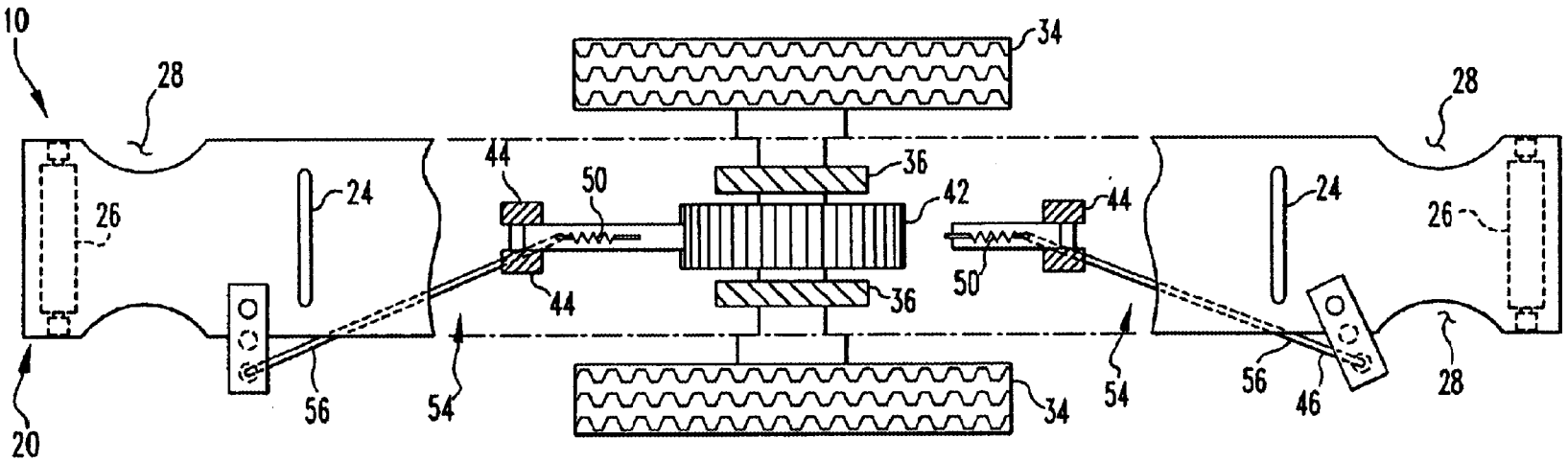
FIG. 2 is a top view of the present invention.
Figure 3:
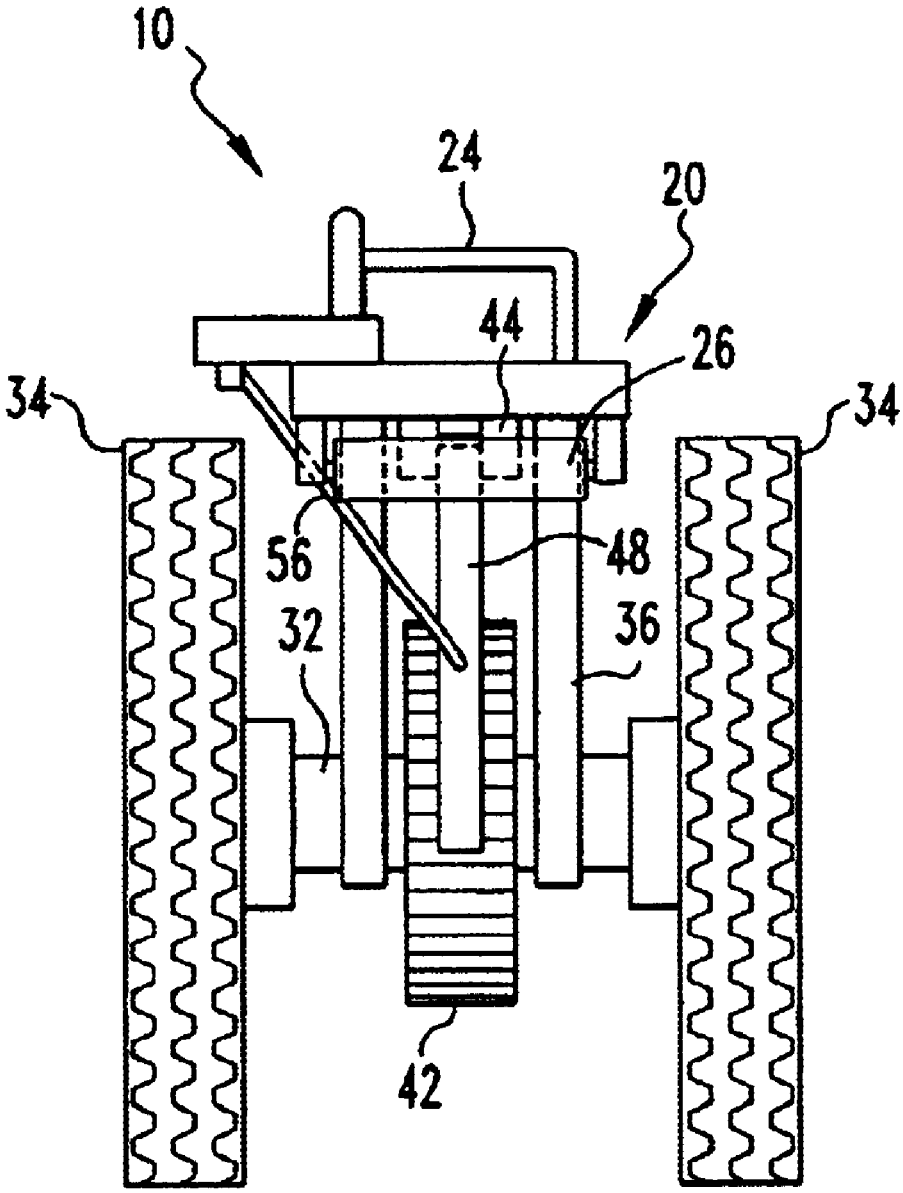
FIG. 3 is an end view of the present invention.

As shown in FIGS. 1–3, the seesaw 10 comprises a planar member assembly 20, an axle assembly 30, and a ratchet-and-pawl assembly 40. The planar member assembly 20 includes a planar member 22 which is an elongated, generally flat board having a length between about 4 feet and 14 feet, and is preferably about 8 feet and a width between about 3 inches and 14 inches, and more preferably about 8 inches. The planar member 22 has a lower side 23 and an upper side 25. The planar member assembly 20 further includes two handles 24, a plurality of rollers, or small wheels 26, and a plurality of leg cutouts 28. The handles 24 are attached adjacent to the planar member upper side 25 at either end of the planar member 22 for the user to grasp. The planar member 22 may also have the rollers 26 coupled to the planar member lower side 23 at the distal ends of the planar member 22 to reduce wear and tear as the seesaw travels, as described below. If the planar member 22 is wide, the planar member 22 may have leg cutouts 28 adjacent to the distal ends of the planar member 22 for the comfort of the user.

The axle assembly 30 includes an axle 32, a pair of wheels 34, and a pair of radial extension 36. The axle 32 is an elongated, preferably circular, rod. The axle has a length sufficient to extend beyond the width of the planar member 22. One wheel 34 is coupled to each end of the axle 32. The wheels 34, preferably, have a diameter between about 8 inches to 60 inches, and more preferably about 26 inches. The radial extensions 36 may be single elongated members but are, preferably, yokes 35. The radial extensions are also coupled to the axle 32. The radial extensions 36 have a length at least as great as the radius of the toothed gear 42 (described below), and are preferably between about 2 feet and 5 feet in length, and more preferably about 2.5 feet. The radial extensions 36 are disposed with one on either side of the toothed gear 42 and are spaced from each other at a distance approximately equal to the width of the planar member 22.

The ratchet-and-pawl assembly 40 includes a toothed gear 42, a pair of pawl assemblies 44, and may include a release device 46. The toothed gear 42 is coupled to the axle 32, preferably at a medial location. The toothed gear 42 preferably has a diameter between about 4 inches to 30 inches, and more preferably about 12 inches. Each pawl assembly includes an elongated, rigid pawl member 48 and a spring 50. Each pawl member 48 is pivotally attached at one end to the planar member lower side 23, preferably along the longitudinal axis of the planar member 22. The pawl members 48 are coupled to the planar member 22 at a generally medial distance between the center of the planar member 22 and the ends or the planar member 22. The pawl members 48 are each spaced about the same distance from the center of the planar member 22. The distal end of each pawl member 48 extends generally toward the center of the planar member 22 and, as detailed hereinafter, contacts the toothed gear 42. Each pawl assembly spring 50 is also coupled to the planar member lower side 23 and is disposed between the pawl member 48 and the center of the planar member 22. Each pawl spring 50 is structured to bias the pawl member 48 toward the center or the planar member, and, as described below, into engagement with the toothed gear 42.

The pawl release device 46 is structured to overcome the bias of the pawl spring 50 and move the pawl member 48 out of engagement with the toothed gear 42. The pawl release device 46 is preferably a rotating cam 52 that is coupled to the planar member lower side 23 immediately adjacent to the pawl member 48 pivot point. The cam 52 may rotate between a first position where the cam 52 does not engage the pawl member 48 and a second position wherein the cam 52 engages the pawl member. The pawl release device 46 may further include an actuator 54, such as a rod 56, that extends from the cam 52 to a location adjacent the distal end of the planar member 22. Thus, a user may move the cam 52 between the first position and the second position while seated on the planar member 22.

When assembled, the radial extensions 36 are coupled to either side of the planar member 22 at a medial location. Thus, the planar member 22 extends about an equal distance on either side of the axle 32. In this configuration, the axle 32 acts as a fulcrum. That is, the ends of planar member 22 may be moved between opposing upper and lower positions. The pawl members 48 each extend toward the toothed gear 42 and may be moved between a first position wherein said pawl member 48 engages the toothed gear 42 and a second position wherein the pawl member 48 does not engage the toothed gear 42.

Each pawl spring 50 biases the associated pawl member 48 into the first position. The cam 52, when placed in the cam second position, moves the pawl member 48 into the pawl member second position. When a pawl member is in the first position, the action of rocking the planar member 22 causes the pawl to act on the toothed gear 42 which in turn causes the axle 32 to rotate. The rotation of the axle 32 causes the seesaw 10 to travel in a direction parallel to the longitudinal axis of the planar member 22. If both pawl assemblies 44 engage the toothed gear 42, the seesaw 10 moves both forward and backwards as the planar member 22 is rocked on the fulcrum. Thus, the seesaw 10 remains in essentially one location with a short range of travel. In this configuration, the children using the seesaw 10 experiences a motion of rocking up and down, rotating along with the radial extensions 36 about the axle 32, and traveling to and fro.

A user may disengage one of the pawl members 48, that is, move the pawl member 48 into the second position, by actuating the pawl release device 46. This causes the cam 52 to move from the first position into the second position, thereby overcoming the bias of the pawl spring 50 and moving the pawl member 48 into the second position. In this configuration, only one pawl member 48 acts on the toothed gear 42 so the toothed gear 42 is only rotated in a single direction. Thus, the seesaw 10 will move in a single direction generally parallel to the longitudinal axis of the planar member 22.

While specific embodiments of the invention have been described in detail, it will be appreciated by those skilled in the art that various modifications and alternatives to those details could be developed in light of the overall teachings of the disclosure. For example, the radial extensions may be eliminated and the toothed gear may have a substantially smaller radius. Accordingly, the particular arrangements disclosed are meant to be illustrative only and not limiting as to the scope of the invention which is to be given the full breadth of the claims appended and any and all equivalents thereof.

What is claimed is:

1. A seesaw comprising:

an elongated planar member assembly having an elongated planar member;

an axle assembly having an axle member, an elongated radial extension, and a pair of wheels;

said radial extension extending radially between, and coupled to, said axle member and said planar member;

said pair of wheels coupled to said axle member, one wheel disposed on each side of said planar member;

a ratchet-and-pawl assembly comprising:

a toothed gear coupled to said axle member;

a pair of pawl assemblies each having a pawl member coupled to said planar member and structured to engage said toothed gear; and wherein each said pawl member is structured to move from a first position wherein said pawl engages said toothed gear and a second position wherein said pawl does not engage said toothed gear.

2. The see-saw of claim 1 wherein:

each said pawl member is structured to move from a first position wherein each said pawl member engages said toothed gear and a second position wherein each said pawl member does not engage said toothed gear; and each said pawl member may be moved independent of the other pawl member.

3. The see-saw of claim 2 wherein each said pawl assembly includes a spring structured to bias the pawl member into the first position.

4. The see-saw of claim 3 wherein each said pawl assembly includes a pawl release device structured to move said pawl member into said second position.

5. The seesaw of claim 2 wherein said planar member has a length between about 4 feet and 14 feet.

6. The seesaw of claim 5 wherein said planar member has a length of about 8 feet.

7. The seesaw of claim 2 wherein said wheels have a diameter between about 8 inches and 60 inches.

8. The seesaw of claim 7 wherein said wheels have a diameter of about 26 inches.

9. The see-saw of claim 8 wherein:

said planar member is structured to rock about said pivot point between a first position wherein one end of said planar member contacts the ground and a second position wherein the other end of said planar member contacts the ground; and each said pawl is structured to move over one tooth on said toothed gear each time said elongated member moves between said first and second positions or vice-versa.

10. The seesaw of claim 2 wherein said elongated radial extension member has a length between about 2 feet and 5 feet.

11. The seesaw of claim 10 wherein said elongated radial extension member has a length of about 2.5 feet.

12. The see-saw of claim 11 wherein:

said planar member has a length of about 8 feet; and said wheels have a diameter of about 26 inches.

* * * * *